US012674407B2

(12) United States Patent
Miyake et al.

(10) Patent No.: US 12,674,407 B2
(45) Date of Patent: Jul. 7, 2026

(54) TANK FOR USE IN TEMPERATURE CONTROL SYSTEM AND TEMPERATURE CONTROL SYSTEM

(71) Applicant: TOYODA GOSEI CO., LTD., Kiyosu (JP)

(72) Inventors: Kazutoshi Miyake, Kiyosu (JP); Kenichiro Kaneko, Kiyosu (JP)

(73) Assignee: TOYODA GOSEI CO., LTD., Aichi-pref. (JP)

( * ) Notice: Subject to any disclaimer, the term of this patent is extended or adjusted under 35 U.S.C. 154(b) by 328 days.

(21) Appl. No.: 18/489,467

(22) Filed: Oct. 18, 2023

(65) Prior Publication Data

US 2024/0141821 A1 May 2, 2024

(30) Foreign Application Priority Data

Nov. 1, 2022 (JP) ..... 2022-175187

(51) Int. Cl.

| | |
|---|---|
| ***F01P 7/16*** | (2006.01) |
| ***F01P 3/20*** | (2006.01) |
| ***F01P 5/12*** | (2006.01) |
| ***F01P 7/14*** | (2006.01) |

(52) U.S. Cl.

CPC ..... *F01P 7/16* (2013.01); *F01P 3/207* (2013.01); *F01P 5/12* (2013.01); *F01P 2007/146* (2013.01); *F01P 2060/08* (2013.01)

(58) Field of Classification Search

CPC ..... F01P 7/16; F01P 3/207; F01P 5/12; F01P 2007/146; F01P 2060/08; F01P 11/029; B60K 2001/005; B60K 11/02

See application file for complete search history.

(56) References Cited

U.S. PATENT DOCUMENTS

| | | | | |
|---|---|---|---|---|
| 10,665,908 | B2 * | 5/2020 | Krull | H01M 10/613 |
| 2021/0180505 | A1 * | 6/2021 | Jeong | F01P 11/0285 |
| 2024/0017605 | A1 * | 1/2024 | He | B60H 1/00485 |

FOREIGN PATENT DOCUMENTS

| | | | | |
|---|---|---|---|---|
| DE | 4103523 | A1 * | 8/1992 | B60S 1/487 |
| FR | 2722834 | A1 * | 1/1996 | F01P 5/10 |

(Continued)

OTHER PUBLICATIONS

Machine Translation of FR 2722834 A1 PDF File Name: "FR2722834A1_Machine_Translation.pdf" (Year: 1996).*

(Continued)

*Primary Examiner* — Grant Moubry
*Assistant Examiner* — Ruben Picon-Feliciano
(74) *Attorney, Agent, or Firm* — Posz Law Group, PLC

(57) ABSTRACT

A tank that is used in a temperature control system and that accommodates coolant used for temperature control includes a container body having an opening and configured to accommodate the coolant; a lid portion covering the opening, the lid portion including a pump housing portion recessed toward an inner side of the container body and including a through hole extending through an inside of the container body, and at least one inflow port into which the coolant flows from a coolant circuit of the temperature control system; and a pump housed in the pump housing portion and configured to draw the coolant accommodated in the container body through the through hole.

4 Claims, 9 Drawing Sheets

(56) References Cited

FOREIGN PATENT DOCUMENTS

| | | | | |
|---|---|---|---|---|
| JP | 2014-058241 A | 4/2014 | | |
| KR | 102115927 B1 * | 5/2020 | ..... | F16K 11/056 |

OTHER PUBLICATIONS

Machine Translation of DE 4103523 A1 PDF File Name: "DE4103523A1_Machine_Translation.pdf" (Year: 1992).*
Machine Translation of KR 102115927 B1 PDF File Name: "KR102115927B1_Machine_Translation.pdf" (Year: 2020).*

* cited by examiner

TANK FOR USE IN TEMPERATURE CONTROL SYSTEM AND TEMPERATURE CONTROL SYSTEM

CROSS-REFERENCE TO RELATED APPLICATIONS

This application claims priority based on Japanese Patent Application No. 2022-175187 filed on Nov. 1, 2022, the entire disclosure of which is incorporated herein by reference.

BACKGROUND

Field

The present disclosure relates to a tank for use in a temperature control system and a temperature control system.

Related Art

To cool a battery or inverter in a vehicle, a technique is known in which a coolant (cooling medium) cooled by a radiator is supplied to the battery or inverter and heat exchange is performed. For example, JP 2014-58241 A discloses a temperature control system including one tank that accommodates a coolant, and two circulation paths through which the coolant is circulated to the inverter and the battery, respectively. The temperature control system is configured to supply the coolant from the tank to one of the two circulation paths by using one pump.

However, in JP 2014-58241 A, no information about the detailed configuration of the pump and the tank is given. Thus, there is still room for improvement in terms of reducing the size of the pump and the tank and increasing ease of maintenance.

SUMMARY

The present disclosure may be implemented in the form of the following aspects.

According to an aspect of the present disclosure, there is provided a tank that is used in a temperature control system and that accommodates coolant used for temperature control. The tank includes a container body having an opening and configured to accommodate the coolant; a lid portion covering the opening, the lid portion including a pump housing portion recessed toward an inner side of the container body and including a through hole extending through an inside of the container body, and at least one inflow port into which the coolant flows from a coolant circuit of the temperature control system; and a pump housed in the pump housing portion and configured to draw the coolant accommodated in the container body through the through hole.

DETAILED DESCRIPTION

A. First Embodiment

A1. Configuration of Temperature Control System 300

Figure 1:
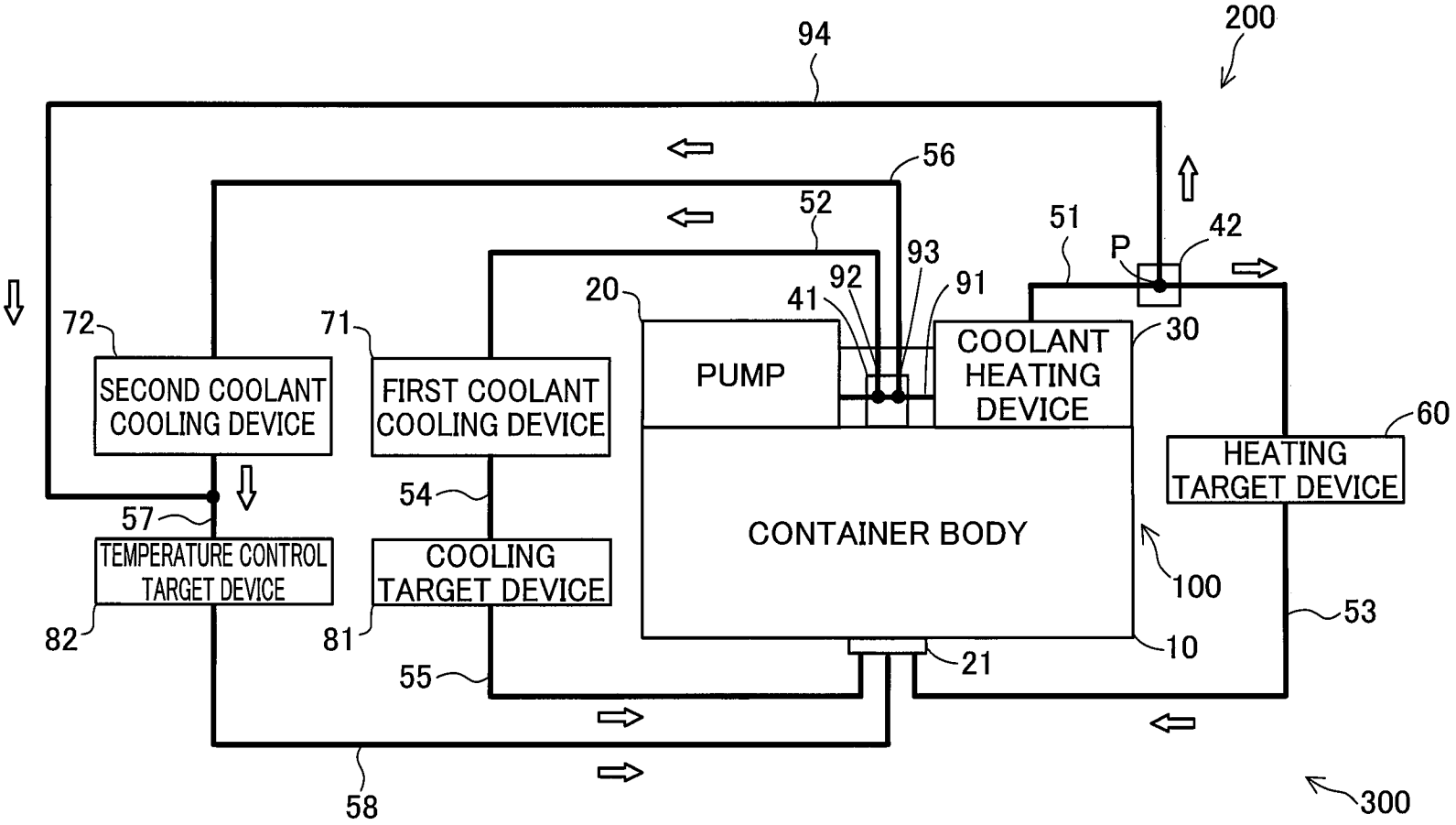
FIG. 1 is a diagram illustrating a schematic configuration of a temperature control system according to an aspect of the present disclosure.

FIG. 1 is a diagram illustrating a schematic configuration of a temperature control system 300 according to an aspect of the present disclosure. The white arrows in FIG. 1 denote the direction in which a coolant flows. The temperature control system 300 is used to control the temperature of a device subject to temperature control by causing heat exchange between a coolant that has been cooled or heated and the device. The temperature control system 300 is installed in, for example, a battery electric vehicle (BEV). The temperature control system 300 according to the present embodiment uses a coolant for temperature control and accommodated in one tank 100 to control the temperature of a heating target device 60, a cooling target device 81, and a temperature control target device 82.

The temperature control system 300 includes the tank 100, a pump 20, a coolant heating device 30, the heating target device 60, a first coolant cooling device 71, a second coolant cooling device 72, the cooling target device 81, the temperature control target device 82, and a coolant circuit 200.

The tank 100 is a container that accommodates the coolant. A detailed configuration of the tank 100 will be described later. The pump 20 is mounted to a lid portion 11 of the tank 100 and supplies the coolant stored in the tank 100 to a first tank flow path 91. A detailed configuration of the pump 20 will be described later. The first tank flow path 91 is a flow path provided in the lid portion 11 of the tank 100 and causes the coolant to flow to the coolant heating device 30. The first tank flow path 91 is connected to a second tank flow path 92 and a third tank flow path 93, which will be described later. After being supplied to the first tank flow path 91, a first valve 41 causes the coolant to flow to at least one of the coolant heating device 30, the second tank flow path 92, and the third tank flow path 93. A detailed configuration of the first valve 41 will be described later.

The coolant heating device 30 is mounted to the lid portion 11 of the tank 100, similar to the pump 20, and heats and sends the coolant. In the present embodiment, the coolant heating device 30 is a coolant heater, but the coolant heating device 30 is not limited to a coolant heater and may be any device that can heat a coolant. The heating target device 60 is heated by exchanging heat with the coolant that has been heated by the coolant heating device 30. In the present embodiment, the heating target device 60 is a heater core used as part of an air conditioning device for a vehicle cabin. However, the heating target device 60 is not limited to a heater core and may be any device that can be heated by a heated coolant. The first coolant cooling device 71 cools the coolant and supplies this coolant to the cooling target device 81. The second coolant cooling device 72 cools the coolant and supplies this coolant to the temperature control target device 82. In the present embodiment, the first coolant cooling device 71 and the second coolant cooling device 72 are each a radiator, but the first coolant cooling device 71 and the second coolant cooling device 72 are not limited to a radiator and may be any device that can cool a coolant. The cooling target device 81 is cooled by exchanging heat with the coolant that has been cooled by the first coolant cooling device 71. In the present embodiment, the cooling target device 81 is a motor and an inverter. Note that, the cooling target device 81 is not limited to a motor or an inverter and may be any device that can be cooled by the cooled coolant. The temperature control target device 82 is heated by exchanging heat with the coolant heated by the coolant heating device 30 and is cooled by exchanging heat with the coolant cooled by the second coolant cooling device 72. In the present embodiment, the control target device 82 is a battery and a converter. The temperature control target device 82 is not limited to a battery or a converter and may be any device that can be cooled by the cooled coolant and heated by the heated coolant.

The coolant circuit 200 is a flow path that causes the coolant to circulate between the tank 100, the coolant heating device 30, the heating target device 60, the first coolant cooling device 71, the second coolant cooling device 72, the cooling target device 81, and the temperature control target device 82.

The coolant circuit 200 includes a first flow path 51, a second flow path 52, a third flow path 53, a fourth flow path 54, a fifth flow path 55, a sixth flow path 56, a seventh flow path 57, an eighth flow path 58, a bypass flow path 94 and a second valve 42. Each of the first to eighth flow paths 51 to 58 and the bypass flow path 94 is composed of a member through which the coolant can circulate. Example of such a member include a rubber hose tube and a nylon tube.

The first flow path 51 connects the coolant heating device 30 to the heating target device 60. The third flow path 53 connects the heating target device 60 to an inflow port 21 provided in the tank 100. The inflow port 21 is provided in the lid portion 11 of the tank 100 and can be connected to each of the flow paths. The second flow path 52 connects the second tank flow path 92 to the first coolant cooling device 71. The second tank flow path 92 is a flow path provided in the lid portion 11 of the tank 100 and connects the first tank flow path 91 to the second flow path 52. The fourth flow path 54 connects the first coolant cooling device 71 to the cooling target device 81. The fifth flow path 55 connects the cooling target device 81 to the inflow port 21. The sixth flow path 56 connects the third tank flow path 93 to the second coolant cooling device 72. The third tank flow path 93 is a flow path provided in the lid portion 11 of the tank 100 and connects the first tank flow path 91 to the sixth flow path 56. The seventh flow path 57 connects the second coolant cooling device 72 to the temperature control target device 82. The eighth flow path 58 connects the temperature control target device 82 to the inflow port 21.

The bypass flow path 94 connects the first flow path 51 to the seventh flow path 57. The second valve 42 is provided at a connection point P between the bypass flow path 94 and the first flow path 51. The second valve 42 causes the coolant supplied to the first flow path 51 to circulate to at least one of the bypass flow path 94 and the heating target device 60. In other words, the coolant heated by the coolant heating device 30 exchanges heat with at least one of the heating target device 60 and the temperature control target device 82.

A2. Configuration of Tank 100

Figure 2:
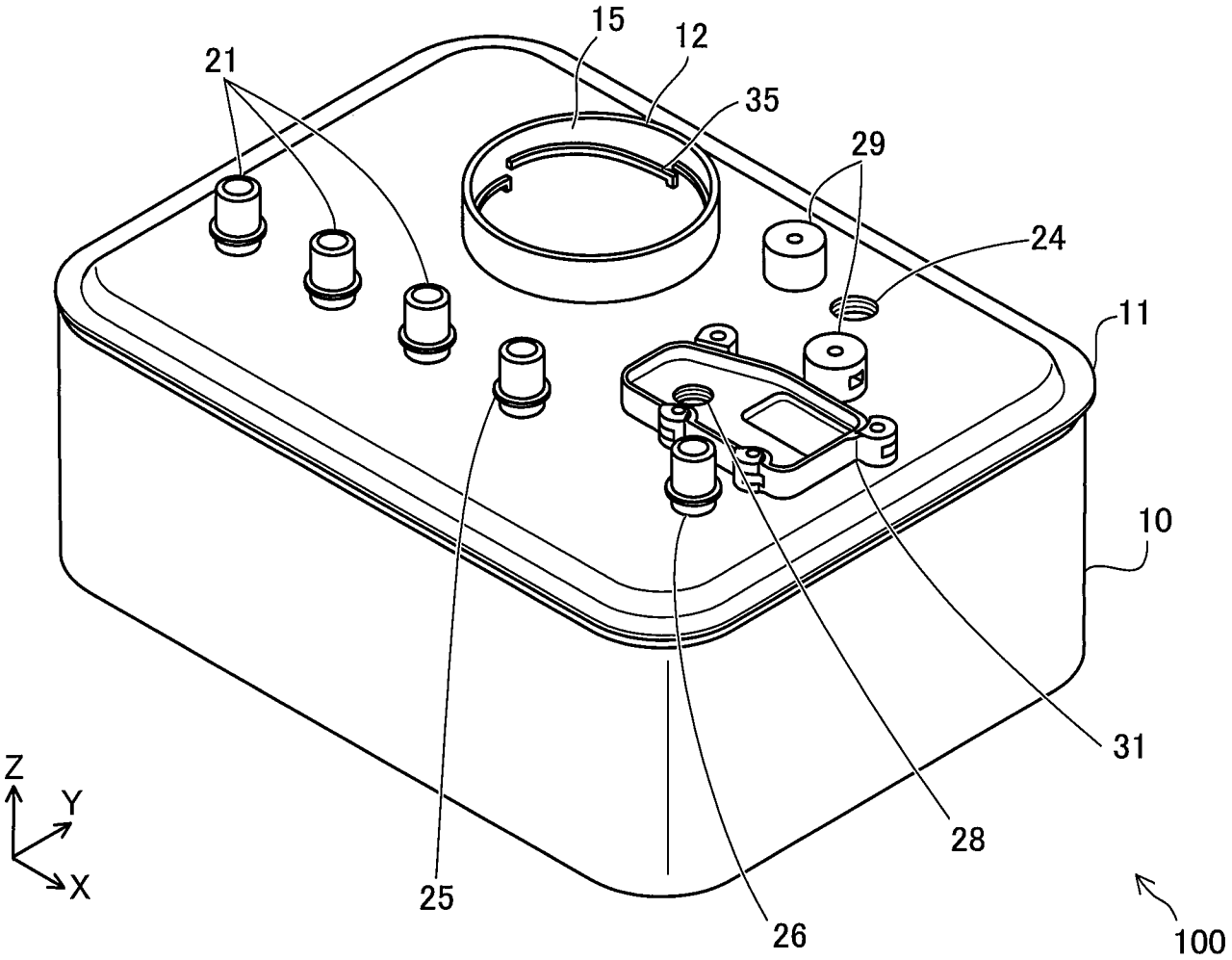
FIG. 2 is a perspective view illustrating a tank according to an aspect of the present disclosure.

FIG. 2 is a perspective view of the tank 100 according to an aspect of the present disclosure. Mutually orthogonal XYZ axes are illustrated in FIG. 2. Hereafter, the +Z direction will also be referred to as "up" and the −Z direction will also be referred to as "down". The XYZ axes in FIG. 2 correspond to the XYZ axes in other drawings.

The tank 100 is a container used in the temperature control system 300 and is configured to accommodate the coolant. The tank 100 includes a container body 10 and the lid portion 11.

The container body 10 is configured to accommodate the coolant. The container body 10 has a substantially rectangular shape with an opening at the top. The container body 10 is made of, for example, polypropylene (PP), glass fiber reinforced polypropylene (GFPP), or the like.

The lid portion 11 covers the opening of the container body 10. The lid portion 11 has a substantially flat plate shape. The lid portion 11 is made of, for example, PP or GFRP, similar to the container body 10. The lid portion 11 includes a pump accommodating portion 12 in which the pump 20 is housed, a coolant heating device mounting portion 29 in which the coolant heating device 30 is mounted, an actuator mounting portion 31 in which the actuator 40 is mounted, and the inflow port 21 to which each flow path of the coolant circuit 200 can be connected. The pump accommodating portion 12 has an opening that is open upward and is a depression recessed toward the inside of the container body 10. A threaded portion 35 is provided at the top of the sidewall surface 15 of the pump accommodating portion 12. The threaded portion 35 is configured to be screwed with a screw thread 89 formed in the pump 20, which will be described later. The inflow port 21 is a substantially cylindrical member with an opening open in the vertical direction. At least one inflow port 21 is provided, and the coolant can be distributed between the inside and outside of the tank 100 through the inflow port 21.

Figure 3:
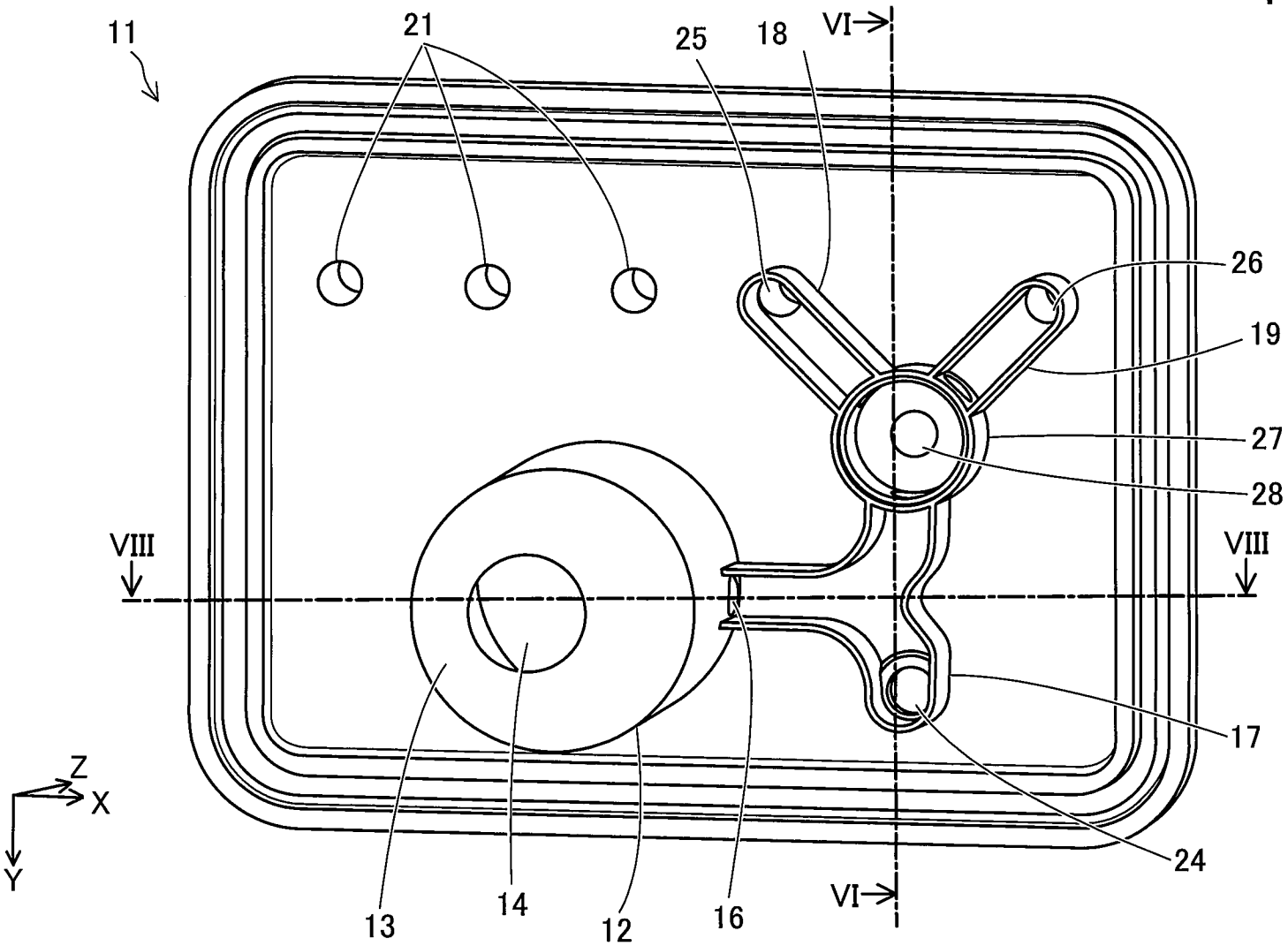
FIG. 3 is a perspective view illustrating a rear side of a lid portion.

FIG. 3 is a perspective view illustrating a rear side of the lid portion 11. Note that, the rear side of the lid portion 11 refers to the container body 10 side when the lid portion 11 covers the container body 10. The lid portion 11 further includes a first tank flow path forming portion 17, a second tank flow path forming portion 18, a third tank flow path forming portion 19, and a first valve housing portion 27.

A bottom surface 13 of the pump accommodating portion 12 includes a first through hole 14 in communication with the interior of the container body 10. The coolant accommodated in the container body 10 is drawn to the pump 20 through the first through hole 14. A second through hole 16 is formed in a side wall surface 15 of the pump accommodating portion 12. The second through hole 16 is connected to the first tank flow path 91, and the coolant drawn by the pump 20 is supplied to the first tank flow path 91 via the second through hole 16. Note that, the first through hole 14 may be formed in the side wall surface 15 instead of or in addition to the bottom surface 13.

The first tank flow path forming portion 17, the second tank flow path forming portion 18, and the third tank flow path forming portion 19 are grooves formed in the rear surface of the lid portion 11. One end of the first tank flow path forming portion 17 is connected to a first outflow port 24. One end of the second tank flow path forming portion 18 is connected to a second outflow port 25. One end of the third tank flow path forming portion 19 is connected to a third outflow port 26. The first outflow port 24 is an opening configured to connect to a coolant inflow port (not illustrated) of the coolant heating device 30. The second outflow port 25 is a substantially cylindrical member with an opening open in the vertical direction and is connected to the second flow path 52. The third outflow port 26 is a substantially cylindrical member having an opening open in the vertical direction and is connected to the sixth flow path 56.

The first valve housing portion 27 houses the first valve 41. The first valve housing portion 27 is located behind the actuator mounting portion 31 in the lid portion 11. The first valve housing portion 27 has a cylindrical shape with an opening open toward the container body 10. The first valve housing portion 27 includes a third through hole 28 into which a shaft portion 7 of the first valve 41 is inserted.

Figure 4:
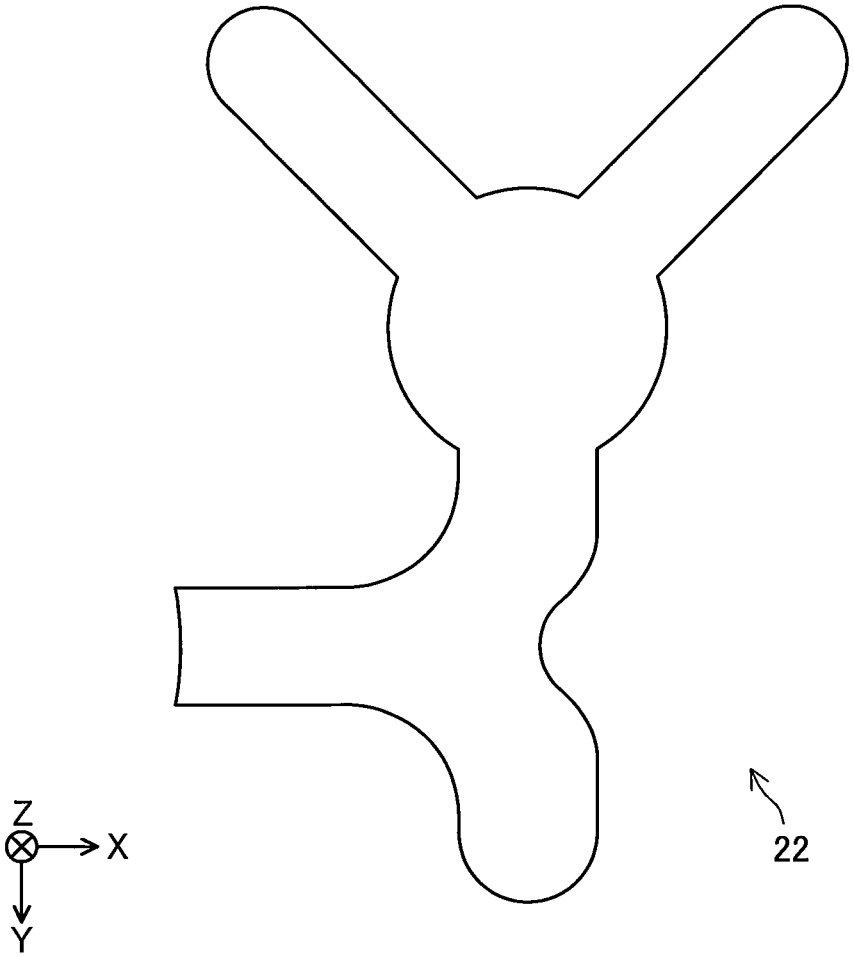
FIG. 4 is a plan view illustrating a flow path forming plate.

FIG. 4 is a plan view illustrating the flow path forming plate 22. The flow path forming plate 22 is a flat plate-shaped member having a shape in plain view that mimics that of the first tank flow path forming portion 17, the second tank flow path forming portion 18, the third tank flow path forming portion 19, and the first valve housing portion 27. The flow path forming plate 22 covers the first tank flow path forming portion 17, the second tank flow path forming portion 18, the third tank flow path forming portion 19, and the first valve housing portion 27 from below, and is fixed to these members by heat welding or the like to form the first tank flow path 91, the second tank flow path 92, and the third tank flow path 93. In other words, the first tank flow path 91 is an area defined by the first tank flow path forming portion 17 and the flow path forming plate 22, the second tank flow path 92 is an area defined by the second tank flow path forming portion 18, a portion of the first valve housing portion 27, and the flow path forming plate 22, and the third tank flow path 93 is an area defined by the third tank flow path forming portion 19, a portion of the first valve housing portion 27, and the flow path forming plate 22.

Figure 5:
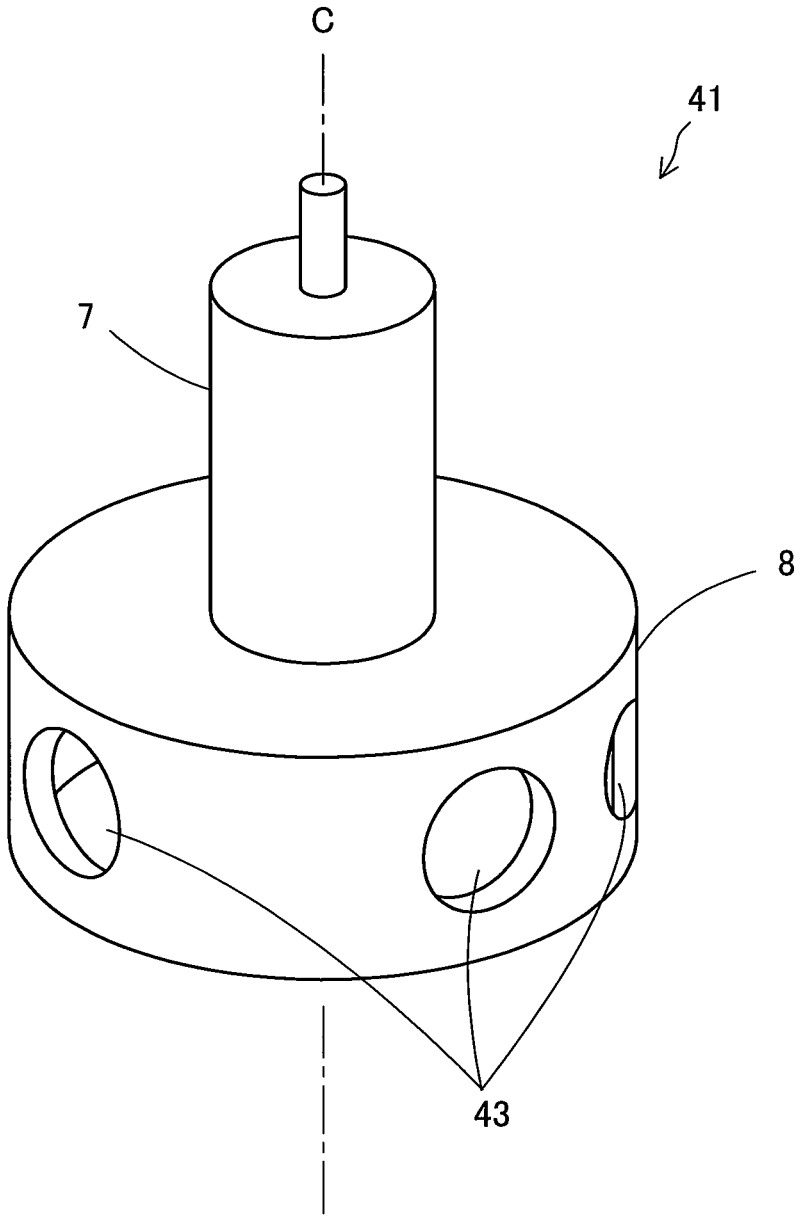
FIG. 5 is a perspective view illustrating a first valve.

FIG. 5 is a perspective view illustrating the first valve 41. The first valve 41 includes a valve body portion 8 and a shaft portion 7. The valve body portion 8 is a hollow cylindrical member with a downward opening. Three valve through holes 43 are formed in a side surface of the valve body portion 8. The shaft portion 7 is a cylindrical member having a central axis C that is the same as that of the valve body portion 8. The diameter of the shaft portion 7 is smaller than the diameter of the valve body portion 8.

Figure 6:
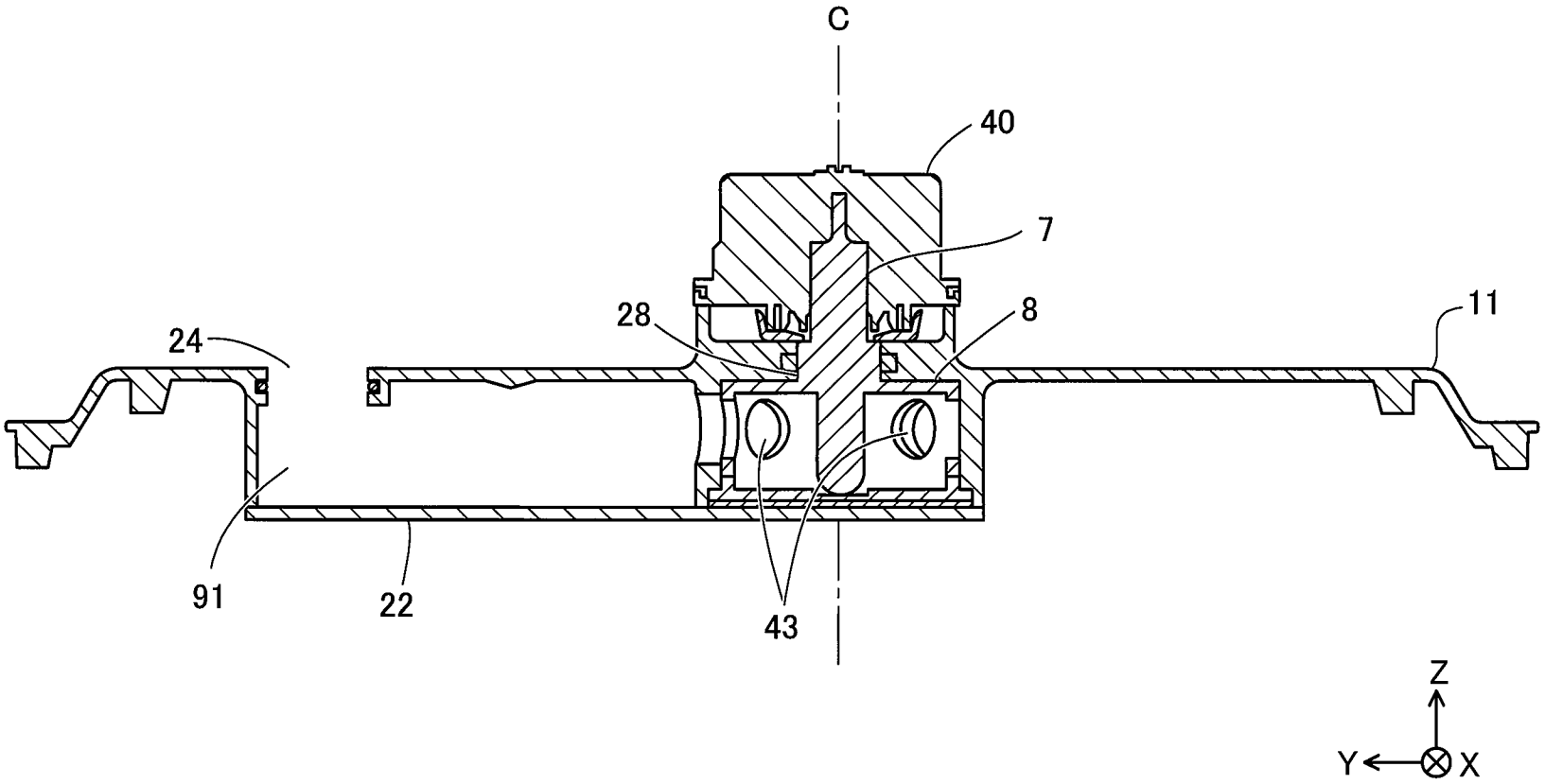
FIG. 6 illustrates a cross section taken along line VI-VI in FIG. 3 in a state where an actuator and the first valve are mounted.

FIG. 6 illustrates a cross section taken along line VI-VI in FIG. 3 in a state where the actuator 40 and the first valve 41 are mounted. The actuator 40 is a device that rotates the shaft portion 7 of the first valve 41 about the central axis C. By such rotation, the position of each valve through hole 43 is aligned with the positions of the first to third tank flow paths 91 to 93. Accordingly, the coolant in the first tank flow path 91 can be distributed to the second tank flow path 92 and the third tank flow path 93, and the flow rate of the distributed coolant can be adjusted according to the rotation amount.

Figure 7:
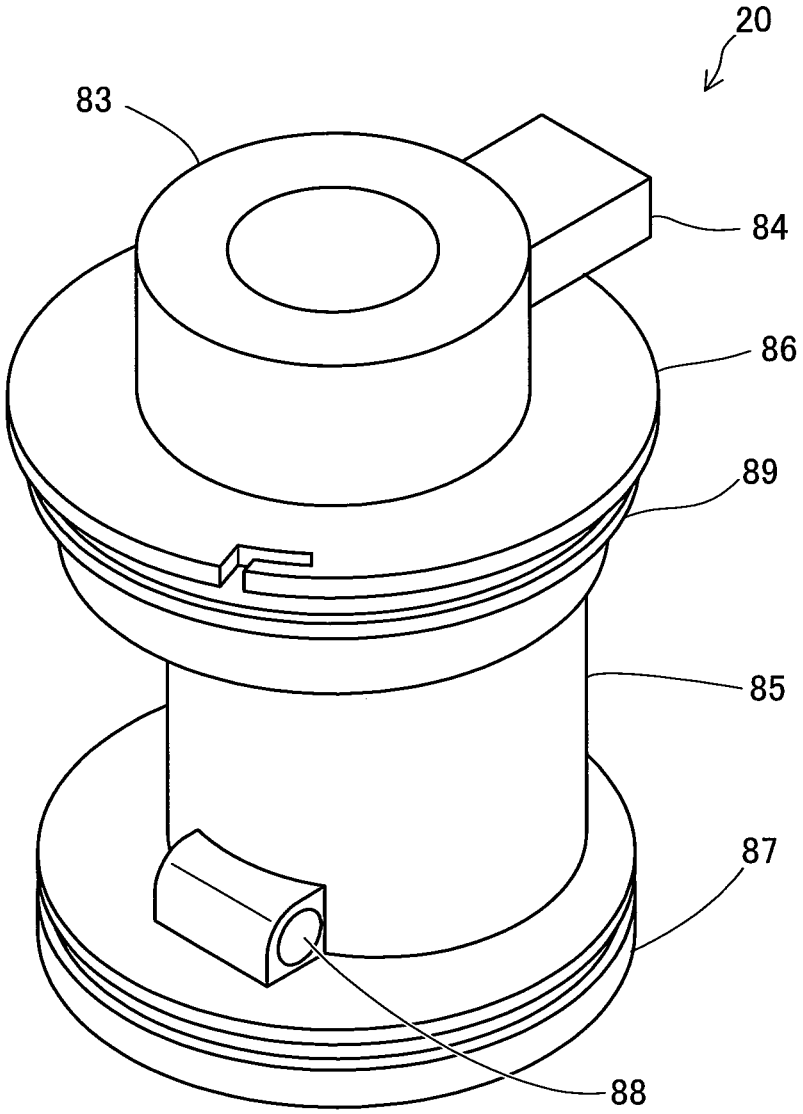
FIG. 7 is a perspective view illustrating a pump.

FIG. 7 is a perspective view illustrating the pump 20. The pump 20 draws the coolant accommodated in the container body 10 through an inlet 90 formed in a bottom portion of the pump 20 and supplies the coolant to the first tank flow path 91. The pump 20 is housed in the pump housing portion 12 formed in the lid portion 11. In the present embodiment, the pump 20 is a centrifugal water pump. The pump 20 includes a handle 83, a connector 84, a housing 85, an upper flange portion 86, a lower flange portion 87, and a discharge port 88.

The handle 83 is a substantially cylindrical member configured to be graspable. The connector 84 is mounted to the handle 83 and a wiring member for supplying power to the pump 20 is connected to the connector 84. The housing 85 is a substantially cylindrical member that houses a motor 75 and an impeller 76. The discharge port 88 is an opening through which the coolant drawn by the pump 20 is discharged to the outside of the pump 20. The discharge port 88 is formed in a side surface of the housing 85.

The upper flange portion 86 is a substantially disk-shaped member provided at a top portion of the housing 85. The lower flange portion 87 is a substantially disk-shaped member provided at a bottom portion of the housing 85. The diameter of each of the upper flange portion 86 and the lower flange portion 87 is larger than that of the housing 85. The upper flange portion 86 and the lower flange portion 87 have substantially the same central axis. The central axes of the upper flange portion 86 and the lower flange portion 87 and the central axis of the housing 85 are offset from each other. The screw thread 89 that screws with the threaded portion 35 of the pump housing portion 12 is formed in an outer peripheral surface of the upper flange portion 86. The pump 20 is fit into the pump housing portion 12 and rotated with the handle 83 to integrate the pump 20 and the lid portion 11. At this time, the lower flange portion 87 makes contact with the bottom surface 13 of the pump housing portion 12, and the upper flange portion 86 seals the opening of the pump housing portion 12.

Figure 8:
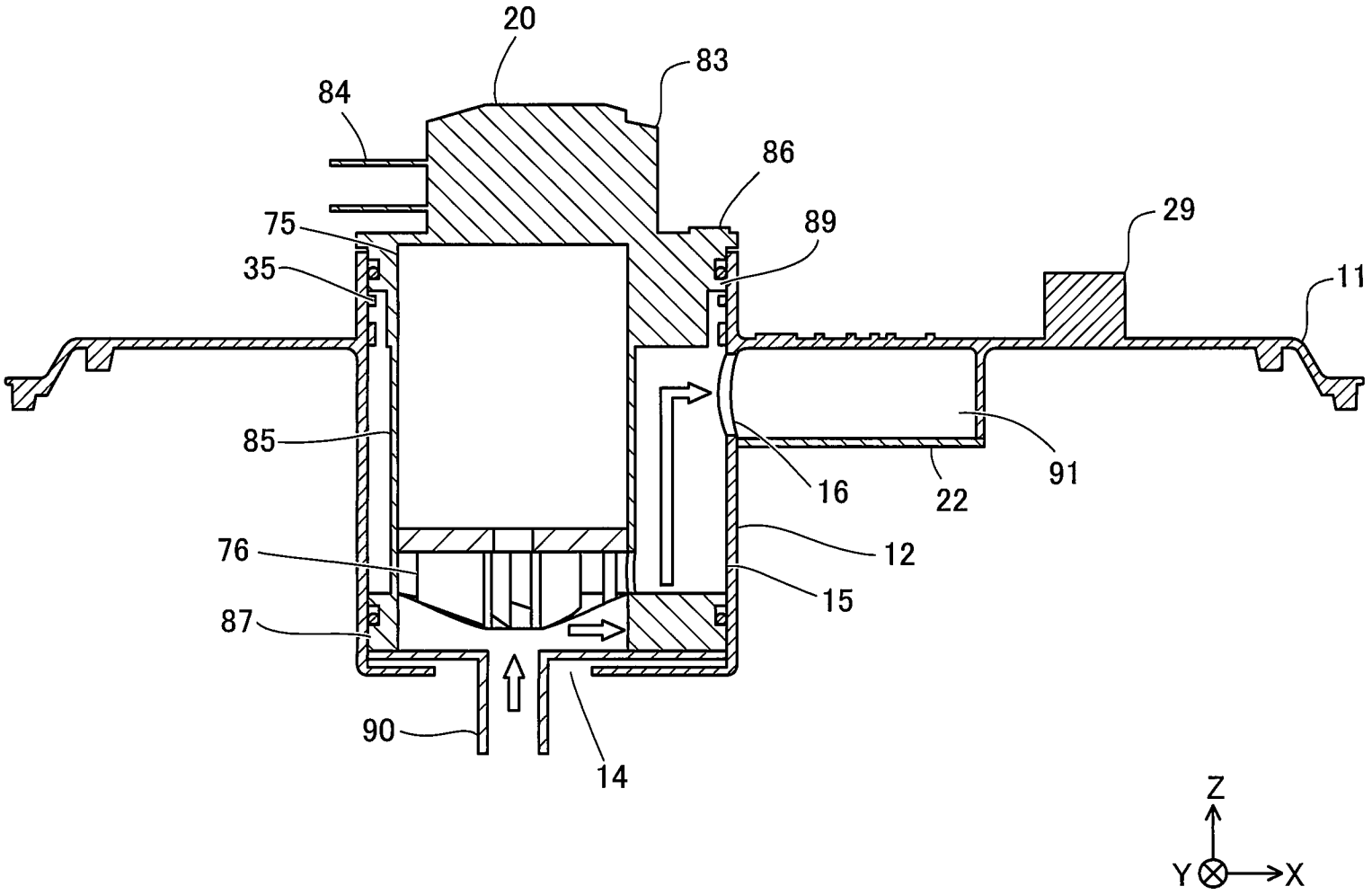
FIG. 8 illustrates a cross section taken along line VIII-VIII in FIG. 3 in a state where the pump is mounted.

FIG. 8 illustrates a cross section taken along line VIII-VIII in FIG. 3 in a state where the pump 20 is mounted. The arrows in FIG. 8 denote the flow of coolant drawn by the pump 20. Illustration of the motor 75 is simplified in FIG. 8. When power is supplied to the pump 20 via the connector 84, the motor 75 operates and causes the impeller 76 to rotate, whereby the coolant is drawn into the pump 20 via the inlet 90 of the pump 20. The suctioned coolant is discharged to the outside of the pump 20 through the discharge port 88. The discharged coolant passes through the area defined by the side surface of the housing 85, the upper flange portion 86 and the lower flange portion 87, and the side wall surface 15 of the pump housing portion 12 and is supplied to the first tank flow path 91 through the second through hole 16.

According to the temperature control system 300 of the first embodiment described above, the coolant accommodated in one tank 100 is drawn by one pump 20 to control the temperature of three devices being the heating target device 60, the cooling target device 81, and the temperature control target device 82. With this configuration, the temperature control system 300 takes up less space as compared to a configuration that requires one pump and one tank for each device subject to temperature control. Further, the manufacturing cost of the temperature control system 300 can be reduced.

According to the tank 100 of the first embodiment described above, since the pump 20 is mounted to the lid portion 11 of the tank 100, less space is required for installation of the tank 100 and the pump 20 as compared to a configuration in which the pump is installed outside the tank.

Since the pump 20 is screwed into the pump housing portion 12, maintenance can be easily performed by rotating the handle 83 and removing the pump 20.

Since the first through hole 14 is formed in the bottom surface 13 of the pump housing portion 12, the pump 20 can be refilled with coolant through the first through hole 14 by removing the pump 20. In other words, the pump 20 can have the function of a cap in the lid portion 11. Therefore, the number of parts can be reduced, meaning that the manufacturing cost of the temperature control system 300 can be reduced as compared to a configuration in which a cap is provided separately from the pump 20.

In addition, since the screw thread 89 formed in the outer surface of the pump 20 screws with the threaded portion 35 of the pump housing portion 12, the pump 20 can be more securely engaged with the tank 100 compared to a configuration not including the thread 89 and the threaded portion 35.

Further, since the coolant heating device 30 is mounted to the lid portion 11, the temperature change of the coolant can be reduced and thermal efficiency can be increased as compared to a configuration in which the tank and the coolant heating device are connected by piping. Specifically, the loss of heat energy of the coolant due to the coolant passing through the piping can be suppressed. Additionally, the space required for installation of the coolant heating device 30 can be reduced.

Further, since the first valve 41 is mounted to the lid portion 11, the space required for installation of the first valve 41 can be reduced as compared to a configuration in which the first valve 41 is located outside of the tank 100.

In addition, since the axes of the upper flange portion 86 and the lower flange portion 87 of the pump 20 and axis of the housing 85 are offset from each other, pressure loss of the coolant circulating in the area defined by the upper flange portion 86 and the lower flange portion 87 and the side wall surface 15 of the pump housing portion 12 can be suppressed compared to a configuration in which these axes are approximately identical.

Further, since the coolant discharged from the pump 20 circulates in the area defined by the upper flange portion 86, the lower flange portion 87, and the side wall surface 15 of the pump housing portion 12, the loss of heat energy of the coolant when passing through the piping can be suppressed as compared to a configuration in which the coolant is supplied from the pump to the refrigerant heating device through the piping.

B. Second Embodiment

Figure 9:
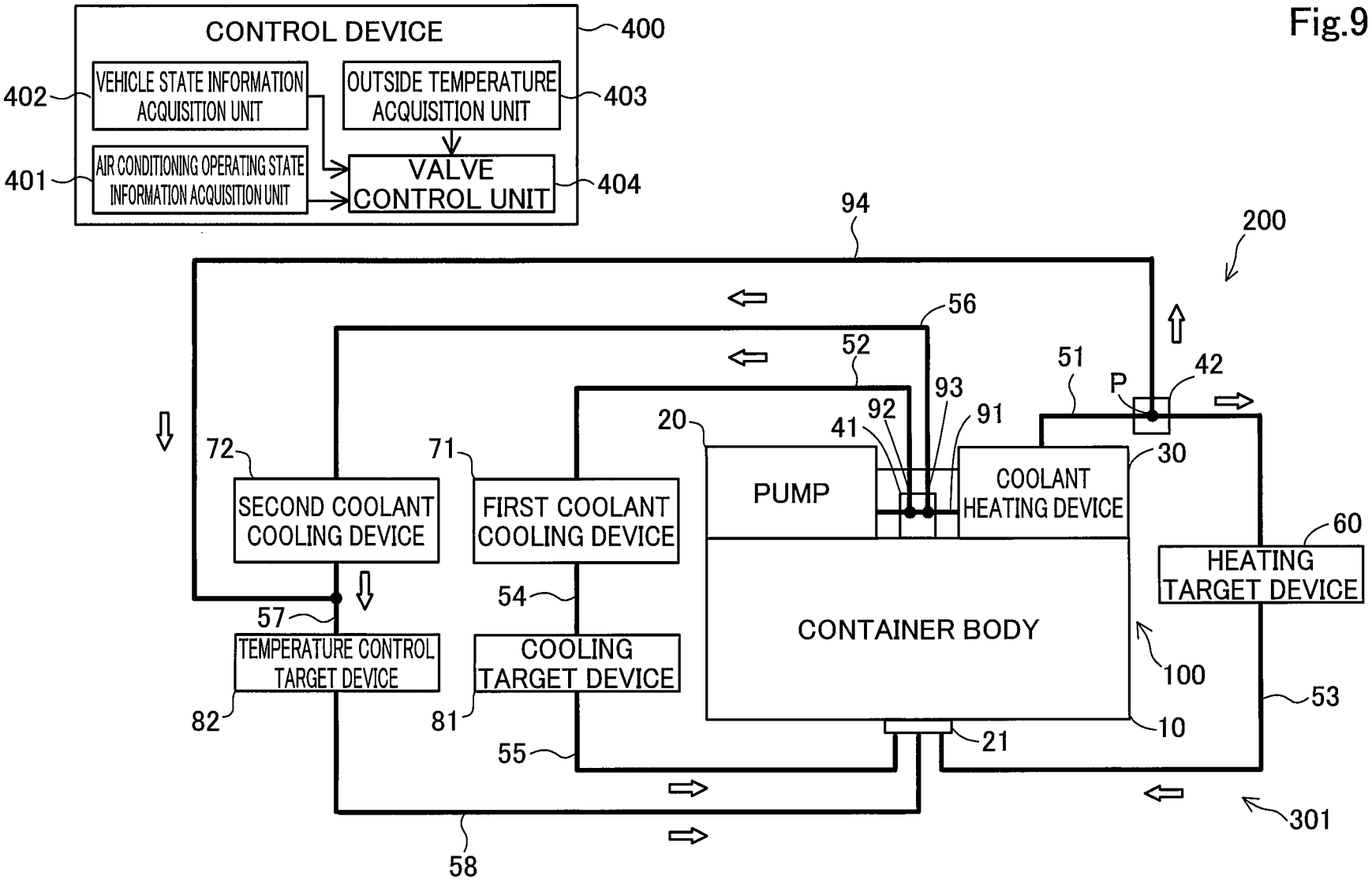
FIG. 9 is a diagram illustrating a schematic configuration of a temperature control system according to a second embodiment.

FIG. 9 is a diagram illustrating a schematic configuration of a temperature control system 301 according to a second embodiment. The temperature control system 301 of the second embodiment differs from the temperature control system 300 of the first embodiment in that the temperature control system 301 further includes a control unit 400. Other configurations in the temperature control system 301 of the second embodiment are the same as those of the temperature control system 300 of the first embodiment, and the same components are denoted by the same symbols and a detailed description thereof will be omitted.

The control unit 400 controls the operation of each component of the temperature control system 301. The control unit 400 is configured by a computer equipped with a CPU and a storage, which are connected to each other by an internal bus. The control unit 400 functions as an air conditioning operating state information acquisition unit 401, a vehicle state information acquisition unit 402, an outside temperature acquisition unit 403, and a valve control unit 404 by executing control programs stored in the storage in advance.

The air conditioning operating state information acquisition unit 401 acquires air conditioning operating state information. In the present embodiment, the air conditioning operating state information is information indicating the operating state of an air conditioning device in the vehicle in which the temperature control system 301 is installed. The operating state of the air conditioning system is, for example, a cooling operation, a heating operation, or non-operation. The air conditioning operating state information acquisition unit 401 sends the acquired air conditioning operating state information to the valve control unit 404.

The vehicle state information acquisition unit 402 acquires vehicle state information. In the present embodiment, the vehicle state information is information indicating the state of the vehicle in which the temperature control system 301 is installed. The vehicle states are, for example, stopped, starting up, low to medium speed travel, high speed travel, and battery charging. Low to medium speed travel means, for example, that the vehicle is traveling at a speed of less than 80 km/h. High speed travel means, for example, that the vehicle is driving at a speed of 80 km/h or more. The vehicle state information acquisition unit 402 sends the acquired vehicle state information to the valve control unit 404.

The outside temperature acquisition unit 403 acquires the outside temperature. In the present embodiment, the outside temperature is the ambient outside temperature of the vehicle in which the temperature control system 301 is installed. The outside temperature acquisition unit 403 sends the acquired outside temperature to the valve control unit 404.

The valve control unit 404 controls at least one of the first valve 41 and the second valve 42 according to the state indicated by at least one of the air conditioning operating state information, the vehicle state information, and the outside temperature.

For example, when the air conditioning operating state information indicates non-operation, the vehicle state information indicates starting up, and the outside temperature is a normal temperature (e.g., 10° C. to 30° C.), and this information is sent to the valve control unit 404, the valve control unit 404 controls the first valve 41 such that the coolant flowing in the first tank flow path 91 flows to the coolant heating device 30, and controls the second valve 42 such that the coolant flowing in the first flow path 51 flows to the bypass flow path 94. With such control, the coolant heated by the coolant heater, which is the coolant heating device 30, is supplied to the battery, which is the temperature control target device 82. In this way, the temperature of the battery is adjusted to a temperature appropriate for startup (e.g., 20° C. to 30° C.).

When, for example, the air conditioning operating state information indicates the heating operation, the vehicle state information indicates starting up, and the outside temperature is a relatively low temperature (e.g., 10° C. or lower), and this information is sent to the valve control unit 404, the valve control unit 404 controls the first valve 41 such that the coolant flowing in the first tank flow path 91 flows to the coolant heating device 30, and controls the second valve 42 such that the coolant flowing in the first flow path 51 flows to the bypass flow path 94 and the heating target device 60. With such control, the coolant heated by the coolant heater, which is the coolant heating device 30, is supplied to the battery, which is the temperature control target device 82, and the heater core, which is the heating target device 60. In this way, the temperature of the battery is adjusted to a temperature appropriate for startup (e.g., 20° C. to 30° C.) and the heater core is heated.

When, for example, the air conditioning operating state information indicates the heating operation, the vehicle state information indicates low to medium speed travel, and the outside temperature is a relatively low temperature (e.g., 10° C. or lower), and this information is sent to the valve control unit 404, the valve control unit 404 controls the first valve 41 such that the coolant flowing in the first tank flow path 91 flows to the coolant heating device 30, and controls the second valve 42 such that the coolant flowing in the first flow path 51 flows to the heating target device 60. By such control, the coolant heated by the coolant heater, which is the coolant heating device 30, is supplied to the heater core, which is the heating target device 60. In this way, the heater core is heated.

When, for example, the air conditioning operating state information indicates the heating operation, the vehicle state information indicates high speed travel, and the outside temperature is a relatively low temperature (e.g., 10° C. or lower), and this information is sent to the valve control unit 404, the valve control unit 404 controls the first valve 41 such that the coolant flowing in the first tank flow path 91 flows to the coolant heating device 30, the second tank flow path 92, and the third tank flow path 93, and controls the second valve 42 such that the coolant flowing in the first flow path 51 flows to the heating target device 60. By such control, coolant is supplied to the radiator, which is the first coolant cooling device 71 and the second coolant cooling device 72, and the coolant cooled by the radiator is supplied to the inverter, which is the cooling target device 81, and the battery, which is the temperature control target device 82. In addition, such control supplies the coolant heated by the coolant heater, which is the coolant heating device 30, to the heater core, which is the heating target device 60. In this way, the battery, which generates heat by supplying power for the air conditioning operation, and the inverter, which generates heat by the high speed travel, are cooled and the heater core is heated.

When, for example, the air conditioning operating state information indicates the cooling operation, the vehicle state information indicates high speed travel, and the outside temperature is a relatively high temperature (e.g., 30° C. or higher), and this information is sent to the valve control unit 404, the valve control unit 404 controls the first valve 41 such that the coolant flowing in the first tank flow path 91 flows to the second tank flow path 92 and the third tank flow path 93. Such control supplies the coolant to the radiator, which is the first coolant cooling device 71 and the second coolant cooling device 72, and the coolant cooled by the radiator is supplied to the inverter, which is the cooling target device 81, and the battery, which is the temperature control target device 82. In this way, the battery, which generates heat by supplying power for the air conditioning operation, and the inverter, which generates heat by the high speed travel, are cooled.

When, for example, the air conditioning operating state information indicates non-operation, the vehicle state information indicates high speed travel, and the outside temperature is a normal temperature (e.g., 10° C. to 30° C.), and this information is sent to the valve control unit 404, the valve control unit 404 controls the first valve 41 such that the coolant flowing in the first tank flow path 91 flows to the second tank flow path 92. By such control, the coolant is supplied to the radiator, which is the first coolant cooling device 71, and the coolant cooled by the radiator is supplied to the inverter, which is the cooling target device 81. In this way, the inverter, which generates heat by the high speed travel, is cooled.

When, for example, the air conditioning operating state information indicates non-operation, the vehicle state information indicates battery charging, the outside temperature is a normal temperature (e.g., 10° C. to 30° C.), and this information is sent to the valve control unit 404, the valve control unit 404 controls the first valve 41 such that the coolant flowing in the first tank flow path 91 flows to the sixth flow path 56. By such control, the coolant is supplied to the radiator, which is the second coolant cooling device 72, and the coolant cooled by the radiator is supplied to the battery, which is the temperature control target device 82. In this way, the battery, which generates heat by the charging, is cooled.

The control of the first valve 41 and the second valve 42 by the valve control unit 404 described above is merely an example. That is, when the heating target device 60 requires heating, the valve control unit 404 controls the first valve 41 such that the coolant flowing in the first tank flow path 91 flows to the coolant heating device 30, and controls the second valve 42 such that the coolant flowing in the first flow path 51 flows to the heating target device 60. When the temperature control target device 82 requires heating, the valve control unit 404 controls the first valve 41 such that the coolant flowing in the first tank flow path 91 flows to the coolant heating device 30, and controls the second valve 42 such that the coolant flowing in the first flow path 51 flows to the bypass flow path 94. When the cooling target device 81 requires cooling, the valve control unit 404 controls the first valve 41 such that the coolant flowing in the first tank flow path 91 flows to the second tank flow path 92. When the temperature control target device 82 requires cooling, the valve control unit 404 controls the first valve 41 such that the coolant flowing in the first tank flow path 91 flows to the third tank flow path 93. The valve control unit 404 may control both the first valve 41 and the second valve 42. The first valve 41 may cause the coolant flowing in the first tank flow path 91 to flow to two or more of the coolant heating device 30, the second tank flow path 92, and the third tank flow path 93. The second valve 42 may cause the coolant flowing in the first flow path 51 to flow to both the heating target device 60 and the bypass flow path 94. The necessity of cooling or heating the heating target device 60, the cooling target device 81, and the temperature control target device 82 may be determined by the valve control unit 404 according to a state indicated by at least one of the air conditioning operating state information, the vehicle state information, and the outside temperature.

According to the temperature control system 301 of the second embodiment described above, the same effects as those of the temperature control system 300 of the first embodiment are achieved. In addition, according to the temperature control system 301 of the second embodiment, the valve control unit 404 controls at least one of the first valve 41 and the second valve 42 according to a state indicated by at least one of the air conditioning operating state information, the vehicle state information, and the outside temperature. Thus, the temperature of the heating target device 60, the cooling target device 81, and the temperature control target device 82 can each be adjusted appropriately according to at least one of the operating state of the air conditioning, the state of the vehicle, and the outside temperature.

C. Other Embodiments (C1) In each embodiment, the temperature control system 300, 301 including the coolant heating device 30, the heating target device 60, the first coolant cooling device 71, the cooling target device 81, the second coolant cooling device 72, and the temperature control target device 82 is described, but no limitation is intended. The temperature control system 300, 301 may have a configuration in which the first coolant cooling device 71, the cooling target device 81, the second tank flow path 92, the second flow path 52, the fourth flow path 54, and the fifth flow path 55 are excluded from the temperature control system 300, 301 of each embodiment. Alternatively, the temperature control system 300, 301 may have a configuration in which the second coolant cooling device 72, the temperature control target device 82, the third tank flow path 93, the sixth flow path 56, the seventh flow path 57, and the eighth flow path 58 are excluded from the temperature control system 300, 301 of each embodiment. Even with such a configuration, the temperature of one of the cooling device 81 and the temperature control target device 82, and the heating target device 60, can be adjusted using one tank 100 and one pump 20.

(C2) In each of the embodiments, the pump 20 and the pump housing portion 12 are screwed together, but no limitation is intended. The pump 20 and the pump housing portion 12 may engage with each other by using any shapes.

(C3) In each of the embodiments, the bypass flow path 94 is connected to the seventh flow path 57, but no limitation is intended. The bypass flow path 94 may be directly connected to the temperature control target device 82. Even with this configuration, the coolant heated by the coolant heating device 30 can be supplied to the temperature control target device 82.

(C4) In each of the embodiments, an example is described in which the temperature control system 300, 301 is installed in an electric vehicle, but no limitation is intended. The temperature control system 300, 301 may be installed in any mobile body or any device that is installed in a fixed location and is equipped with equipment requiring heating and cooling.

(C5) In each of the embodiments, the first valve 41 and the second valve 42 may be valves having any configuration as long as they are capable of distributing coolant flowing through a flow path.

(C6) In each of the embodiments, the second flow path 52, the fourth flow path 54, the sixth flow path 56, and the seventh flow path 57 may be configured by piping consisting of heat pipes or piping including a heat sink to cool the coolant. In such a configuration, the piping configured by heat pipes or the piping including a heat sink corresponds to the first coolant cooling device 71 or the second coolant cooling device 72 of the present disclosure.

(C7) In each of the embodiments, each of the first to third tank flow paths 91 to 93 is provided on the rear side of the lid portion 11, but no limitation is intended. Each of the first to third tank flow paths 91 to 93 may be provided on the front side of the lid portion 11.

The present disclosure is not limited to the embodiments described above and may be implemented in various configurations within a range not departing from the gist of the present disclosure. For example, the technical features in the embodiments can be replaced or combined as appropriate to solve some or all of the above issues or to achieve some or all of the above effects. Any technical feature not described as essential in the specification may be deleted as appropriate. For example, the present disclosure may be realized in the manner described below.

(1) According to an aspect of the present disclosure, there is provided a tank that is used in a temperature control system and that accommodates coolant used for temperature control. The tank includes a container body having an opening and configured to accommodate the coolant; a lid portion covering the opening, the lid portion including a pump housing portion recessed toward an inner side of the container body and including a through hole extending through an inside of the container body, and at least one inflow port into which the coolant flows from a coolant circuit of the temperature control system; and a pump housed in the pump housing portion and configured to draw the coolant accommodated in the container body through the through hole.

According to the tank of this aspect, since the pump is housed in the pump housing portion provided in the lid portion, less space is required for installation of the tank and the pump, as compared to a configuration in which the pump is installed outside the tank. Additionally, since the through hole is formed in the pump housing portion, the coolant can be easily supplied to the container body by removing the pump.

(2) In the tank of the above-described embodiment, the pump housing portion may include a threaded portion configured to screw with a screw thread formed in an outer surface of the pump, and the screw thread may be screwed with the threaded portion to engage the pump with the pump housing portion.

According to the tank of this aspect, since the screw thread formed in the outer surface of the pump screws with the threaded portion of the pump housing portion, the pump can be more reliably engaged with the tank compared to a configuration in which the screw thread and the threaded portion are not provided.

(3) In the tank of the above-described embodiment, the tank may further include a coolant heating device mounted to the lid portion and configured to heat the coolant drawn by the pump and send the coolant to the coolant circuit.

According to the tank of this aspect, since the coolant heating device is mounted to the lid portion, the loss of heat energy of the coolant when passing through the piping can be suppressed as compared to a configuration in which the coolant is supplied from the pump to the refrigerant heating device through the piping. Further, less space is required for installation of the coolant heating device.

(4) In the tank of the above-described embodiment, the lid portion may further include a first tank flow path on a front surface on the container body side, and the first tank flow path may connect the pump and the coolant heating device and supplies the coolant drawn by the pump to the coolant heating device.

According to the tank of this aspect, since the first flow path connecting the pump and the coolant heating device is provided in the lid portion, the loss of heat energy of the coolant when passing through the piping can be suppressed as compared to a configuration in which the flow path connecting the pump and the coolant heating device is provided outside of the tank.

(5) In the tank of the above-described embodiment, the coolant circuit may include a first flow path connecting the coolant heating device and a heating target device configured to be heated by the coolant heated by the coolant heating device, and a second flow path connecting the tank and a first coolant cooling device configured to cool the coolant and supply the coolant to a cooling target device, the lid portion may further include a second tank flow path on the front surface on the container body side, the second tank flow path may connect the first tank flow path and the second flow path and supplies the coolant drawn by the pump to the second flow path, and the tank may include a first valve mounted to the lid portion and configured to cause the coolant drawn from the pump and to be supplied to the first tank flow path to flow to at least one of the coolant heating device or the second tank flow path.

According to the tank of this aspect, since the first valve causes the coolant to flow to at least one of the coolant heating device or the second tank flow path, the coolant can be supplied to the coolant heating device and the first coolant cooling device. Additionally, since the first valve is mounted to the lid portion, less space is required for installation of the first valve as compared to a configuration in which the first valve is provided outside of the tank.

(6) According to another aspect of the present disclosure, there is provided a temperature control system. The temperature control system is a temperature control system including the tank of the above-described embodiment, in which the coolant circuit includes a third flow path connecting the heating target device and the at least one inflow port, a fourth flow path connecting the first coolant cooling device and the cooling target device, a fifth flow path connecting the cooling target device and the at least one inflow port, a sixth flow path connecting the tank and a second coolant cooling device configured to cool the coolant and supply the coolant to a temperature control target device, a seventh flow path connecting the second coolant cooling device and the temperature control target device, an eighth flow path connecting the temperature control target device and the at least one inflow port, and a bypass flow path connecting the first flow path and the seventh flow path or the temperature control target device, the temperature control device further comprising a second valve provided at a connection point between the first flow path and the bypass flow path and being configured to cause the coolant to be supplied to the first flow path to flow to at least one of the temperature control target device or the bypass flow path, the lid portion further includes a third tank flow path on the front surface on the container body side, the third tank flow path connects the first tank flow path and the sixth flow path and supplies the coolant drawn by the pump to the sixth flow path, and the first valve causes the coolant drawn from the pump and to be supplied to the first tank flow path to flow to at least one of the coolant heating device, the second tank flow path, or the third tank flow path.

According to the temperature control system of this aspect, since the bypass flow path is connected to the seventh flow path or the temperature control target device and the second valve supplies the coolant to at least one of the temperature control target device and the bypass flow path, the coolant heated by the coolant heating device can be supplied to the temperature control target device and the heating target device. Further, since the first valve causes the coolant to flow to at least one of the coolant heating device, the second tank flow path, or the third tank flow path, the coolant can be supplied to the coolant heating device, the first coolant cooling device, and the second coolant cooling device.

(7) In the tank of the above-described embodiment, the temperature control system may be installed in and used in a vehicle, the heating target device is used as part of an air conditioning device for a cabin in the vehicle, the temperature control system may further include a control device, the control device including an air conditioning operating state information acquisition unit configured to acquire air conditioning operating state information indicating an operating state of the air conditioning device, a vehicle state information acquisition unit configured to acquire vehicle state information indicating a state of the vehicle, an outside temperature acquisition unit configured to acquire an outside temperature of the vehicle, and a valve control unit configured to control at least one of the first valve or the second valve according to a state indicated by at least one of the acquired air conditioning operating state information, the acquired vehicle state information, or the acquired outside temperature.

According to the temperature control system of this aspect, since the valve control unit controls at least one of the first valve or the second valve according to a state indicated by at least one of the air conditioning operating state information, vehicle state information, or outside temperature, the temperature of the heating target device, the cooling target device, and the temperature control target device can each be adjusted appropriately according to at least one of the operating state of the air conditioning, the state of the vehicle, and the outside temperature.

The present disclosure can be implemented in various forms other than a temperature control system and a tank. For example, the present disclosure can be realized in the form of a method for controlling the opening and closing of a valve in a temperature control system, a computer program for implementing the control method, or a storage medium storing the computer program.

What is claimed is:

1. A temperature control system comprising:

a tank that is used in the temperature control system and that accommodates coolant used for temperature control, the tank comprising:

a container body having an opening and configured to accommodate the coolant;

a lid portion covering the opening, the lid portion including a pump housing portion recessed toward an inner side of the container body and including a through hole extending through an inside of the container body, and at least one inflow port into which the coolant flows from a coolant circuit of the temperature control system;

a pump housed in the pump housing portion and configured to draw the coolant accommodated in the container body through the through hole; and a coolant heating device mounted to the lid portion and configured to heat the coolant drawn by the pump and send the coolant to the coolant circuit, wherein the lid portion further includes a first tank flow path on a front surface on the container body side, the first tank flow path connects the pump and the coolant heating device and supplies the coolant drawn by the pump to the coolant heating device, the coolant circuit includes a first flow path connecting the coolant heating device and a heating target device configured to be heated by the coolant heated by the coolant heating device, and a second flow path connecting the tank and a first coolant cooling device configured to cool the coolant and supply the coolant to a cooling target device, the lid portion further includes a second tank flow path on the front surface on the container body side, the second tank flow path connects the first tank flow path and the second flow path and supplies the coolant drawn by the pump to the second flow path, the tank includes a first valve mounted to the lid portion and configured to cause the coolant drawn from the pump and to be supplied to the first tank flow path to flow to at least one of the coolant heating device or the second tank flow path, the coolant circuit includes a third flow path connecting the heating target device and the at least one inflow port, a fourth flow path connecting the first coolant cooling device and the cooling target device, a fifth flow path connecting the cooling target device and the at least one inflow port, a sixth flow path connecting the tank and a second coolant cooling device configured to cool the coolant and supply the coolant to a temperature control target device, a seventh flow path connecting the second coolant cooling device and the temperature control target device, an eighth flow path connecting the temperature control target device and the at least one inflow port, and a bypass flow path connecting the first flow path and the seventh flow path or the temperature control target device, the temperature control device further comprising a second valve provided at a connection point between the first flow path and the bypass flow path and being configured to cause the coolant to be supplied to the first flow path to flow to at least one of the temperature control target device or the bypass flow path, the lid portion further includes a third tank flow path on the front surface on the container body side, the third tank flow path connects the first tank flow path and the sixth flow path and supplies the coolant drawn by the pump to the sixth flow path, and the first valve causes the coolant drawn from the pump and to be supplied to the first tank flow path to flow to at least one of the coolant heating device, the second tank flow path, or the third tank flow path.

2. The temperature control system according to claim 1, wherein the temperature control system is installed in and used in a vehicle, the heating target device is used as part of an air conditioning device for a cabin in the vehicle, the temperature control system further comprises a control device, the control device including an air conditioning operating state information acquisition unit configured to acquire air conditioning operating state information indicating an operating state of the air conditioning device, a vehicle state information acquisition unit configured to acquire vehicle state information indicating a state of the vehicle, an outside temperature acquisition unit configured to acquire an outside temperature of the vehicle, and a valve control unit configured to control at least one of the first valve or the second valve according to a state indicated by at least one of the acquired air conditioning operating state information, the acquired vehicle state information, or the acquired outside temperature.

3. A temperature control system comprising:

a tank that is used in the temperature control system and that accommodates coolant used for temperature control, the tank comprising:

a container body having an opening and configured to accommodate the coolant;

a lid portion covering the opening, the lid portion including a pump housing portion recessed toward an inner side of the container body and including a through hole extending through an inside of the container body, and at least one inflow port into which the coolant flows from a coolant circuit of the temperature control system;

a pump housed in the pump housing portion and configured to draw the coolant accommodated in the container body through the through hole; and a coolant heating device mounted to the lid portion and configured to heat the coolant drawn by the pump and send the coolant to the coolant circuit, wherein the pump housing portion includes a threaded portion configured to screw with a screw thread formed in an outer surface of the pump, the screw thread is screwed with the threaded portion to engage the pump with the pump housing portion, the lid portion further includes a first tank flow path on a front surface on the container body side, the first tank flow path connects the pump and the coolant heating device and supplies the coolant drawn by the pump to the coolant heating device, the coolant circuit includes a first flow path connecting the coolant heating device and a heating target device configured to be heated by the coolant heated by the coolant heating device, and a second flow path connecting the tank and a first coolant cooling device configured to cool the coolant and supply the coolant to a cooling target device, the lid portion further includes a second tank flow path on the front surface on the container body side, the second tank flow path connects the first tank flow path and the second flow path and supplies the coolant drawn by the pump to the second flow path, the tank includes a first valve mounted to the lid portion and configured to cause the coolant drawn from the pump and to be supplied to the first tank flow path to flow to at least one of the coolant heating device or the second tank flow path, the coolant circuit includes a third flow path connecting the heating target device and the at least one inflow port, a fourth flow path connecting the first coolant cooling device and the cooling target device, a fifth flow path connecting the cooling target device and the at least one inflow port, a sixth flow path connecting the tank and a second coolant cooling device configured to cool the coolant and supply the coolant to a temperature control target device, a seventh flow path connecting the second coolant cooling device and the temperature control target device, an eighth flow path connecting the temperature control target device and the at least one inflow port, and a bypass flow path connecting the first flow path and the seventh flow path or the temperature control target device, the temperature control device further comprising a second valve provided at a connection point between the first flow path and the bypass flow path and being configured to cause the coolant to be supplied to the first flow path to flow to at least one of the temperature control target device or the bypass flow path, the lid portion further includes a third tank flow path on the front surface on the container body side, the third tank flow path connects the first tank flow path and the sixth flow path and supplies the coolant drawn by the pump to the sixth flow path, and the first valve causes the coolant drawn from the pump and to be supplied to the first tank flow path to flow to at least one of the coolant heating device, the second tank flow path, or the third tank flow path.

4. The temperature control system according to claim 3, wherein the temperature control system is installed in and used in a vehicle, the heating target device is used as part of an air conditioning device for a cabin in the vehicle, the temperature control system further comprises a control device, the control device including an air conditioning operating state information acquisition unit configured to acquire air conditioning operating state information indicating an operating state of the air conditioning device, a vehicle state information acquisition unit configured to acquire vehicle state information indicating a state of the vehicle, an outside temperature acquisition unit configured to acquire an outside temperature of the vehicle, and a valve control unit configured to control at least one of the first valve or the second valve according to a state indicated by at least one of the acquired air conditioning operating state information, the acquired vehicle state information, or the acquired outside temperature.

* * * * *